United States Patent [19]

Webinger

[11] Patent Number: 4,586,649

[45] Date of Patent: May 6, 1986

[54] FOOD PACKAGE

[75] Inventor: George P. Webinger, Robbinsdale, Minn.

[73] Assignee: Waldorf Corporation, St. Paul, Minn.

[21] Appl. No.: 579,682

[22] Filed: Feb. 13, 1984

[51] Int. Cl.[4] ..... B65D 5/22; B65D 5/54

[52] U.S. Cl. ..... 229/114; 206/611; 206/626; 229/8; 229/132; 229/903; 248/174; 426/111; 426/113; 426/123; 426/124

[58] Field of Search ..... 229/22, 33, 36, 41 C, 229/41 D, DIG. 3, 8, 176, 52 B; 248/174, 346, 459; 426/111, 113, 122, 123, 124; 206/611, 626

[56] References Cited

U.S. PATENT DOCUMENTS

| | | | |
|---|---|---|---|
| 1,861,206 | 5/1932 | Burgess | 229/8 |
| 1,900,420 | 3/1933 | Shrader | 229/22 |
| 2,133,336 | 10/1938 | Ziemmerman | 229/22 |
| 2,312,507 | 3/1943 | Trogman | 229/33 X |
| 3,038,463 | 6/1962 | Daymon | 229/33 X |
| 3,211,294 | 10/1965 | Maguire | 248/174 X |
| 3,217,968 | 11/1965 | Clarke | 229/22 |
| 3,263,899 | 8/1966 | Collura et al. | 206/626 X |
| 3,403,839 | 10/1968 | Farquhar | 229/52 B |
| 4,036,423 | 7/1977 | Gordon | 229/43 |

FOREIGN PATENT DOCUMENTS

| | | | |
|---|---|---|---|
| 1012863 | 7/1957 | Fed. Rep. of Germany | 229/22 |
| 703035 | 4/1931 | France | 229/17 G |
| 1282708 | 12/1961 | France | 248/174 |
| 1431860 | 2/1966 | France | 229/33 |
| 555422 | 1/1957 | Italy | 229/8 |
| 681711 | 1/1965 | Italy | 229/33 |

*Primary Examiner*—William Price
*Assistant Examiner*—Gary E. Elkins
*Attorney, Agent, or Firm*—Dorsey & Whitney

[57] ABSTRACT

A food package for cooking popcorn in a microwave oven which comprises an inner pouch containing the popcorn kernels, oils and seasoning, an outer paperboard carton in the form of an inverted truncated pyramid and a stand therefor which is adapted to be packaged inside the carton. When the package is to be used, the outer carton is inverted and opened, the stand is removed, erected and placed in a microwave oven. The inverted outer carton is then placed on the stand which insulates the lower portion of the carton. In this position, the popping area of the package is in a position to be affected by maximum microwave energy efficiency and is protected against heat loss for maximum heat efficiency whereby, a higher ratio of popped to unpopped kernels can be obtained.

3 Claims, 9 Drawing Figures

FOOD PACKAGE

BACKGROUND OF THE INVENTION

The present invention relates to an improved four-sided carton adapted to be used for packaging popcorn and more particularly to a four-sided carton for popping popcorn in a microwave oven.

Hertofore, numerous popcorn cartons have been made for packaging popcorn and for popping popcorn in microwave ovens. Such cartons are usually made of paperboard or paper/poly laminates and are sometimes multi-sided or bag shaped. An example of such a paperboard carton is shown in U.S. Pat. No. 4,279,933.

Some such existing popcorn cartons do not have a high energy efficiency and may be subject to some heat losses. The corn kernels and the heat should optimally be concentrated in a small compact area and the configuration of the package should be such that the heavier and smaller unpopped kernels will tend to fall back into that area of greatest energy concentration during the popping process. Hence, the outer carton must be capable of being positioned in a microwave oven so that there is maximum energy efficiency and minimum heat loss.

SUMMARY OF THE INVENTION

The present invention is an improvement over existing packages and has for one of its objects an improved popcorn package for use in microwave ovens.

Another object of the present invention is the provision of an improved popcorn package which yields a high ratio of popped kernels to unpopped kernels.

A further object of the present invention is the provision of an improved popcorn package which permits maximum energy efficiency with minimum heat loss.

An additional object of the present invention is the provision of an improved popcorn package which may be easily manufactured and assembled with automatic machinery.

Other and further objects of the invention will be apparent upon an understanding of the illustrative embodiment about to be described, or will be indicated in the appended claims, and various advantages not referred to herein will occur to one skilled in the art upon employment of the invention in practice.

The invention comprises a food package having a pouch for the popcorn kernels, a paperboard outer carton and a stand on which the carton is adapted to rest. The outer carton resembles two inverted truncated pyramids which are joined base to base, and the stand is in the form of a collapsible tube. Truncation of the pyramidal halves of the carton provides two parallel planar surfaces, one of which is larger than the other to serve as bottom wall for supporting the carton prior to use. A sealed, expandable bag of plastic film, or some other similar material, containing unpopped corn kernels is located within the outer carton. The expandable bag and the stand are separately packaged within the outer carton, and the package may be stored and shipped in that manner until the package is to be used.

When the package is to be used, the outer carton is inverted, and the bottom wall is opened and unfolded so that the carton is transformed into a single open truncated pyramidal form. The stand is removed from within the carton and erected. The lower truncated end of the carton is placed in the open end of the stand so that the carton is supported by the stand and the lower truncated end of the carton lies above the oven floor. The lower truncated wall of the opened carton is small in area so as to form a restricted popping area in the carton which lies within the confines of the stand. The resultant closed air gap created between the carton, the stand and the oven floor serves to provide maximum energy efficiency and helps to insulate the restricted popping area of the carton against heat loss. The popping process then takes place within the expandable bag as will be explained in greater detail hereinafter.

BRIEF DESCRIPTION OF THE DRAWINGS

A preferred embodiment of the invention has been chosen for purposes of illustration and description and is shown in the accompanying drawings forming a part of the specification, wherein.

DETAILED DESCRIPTION OF THE INVENTION

Figure 1:
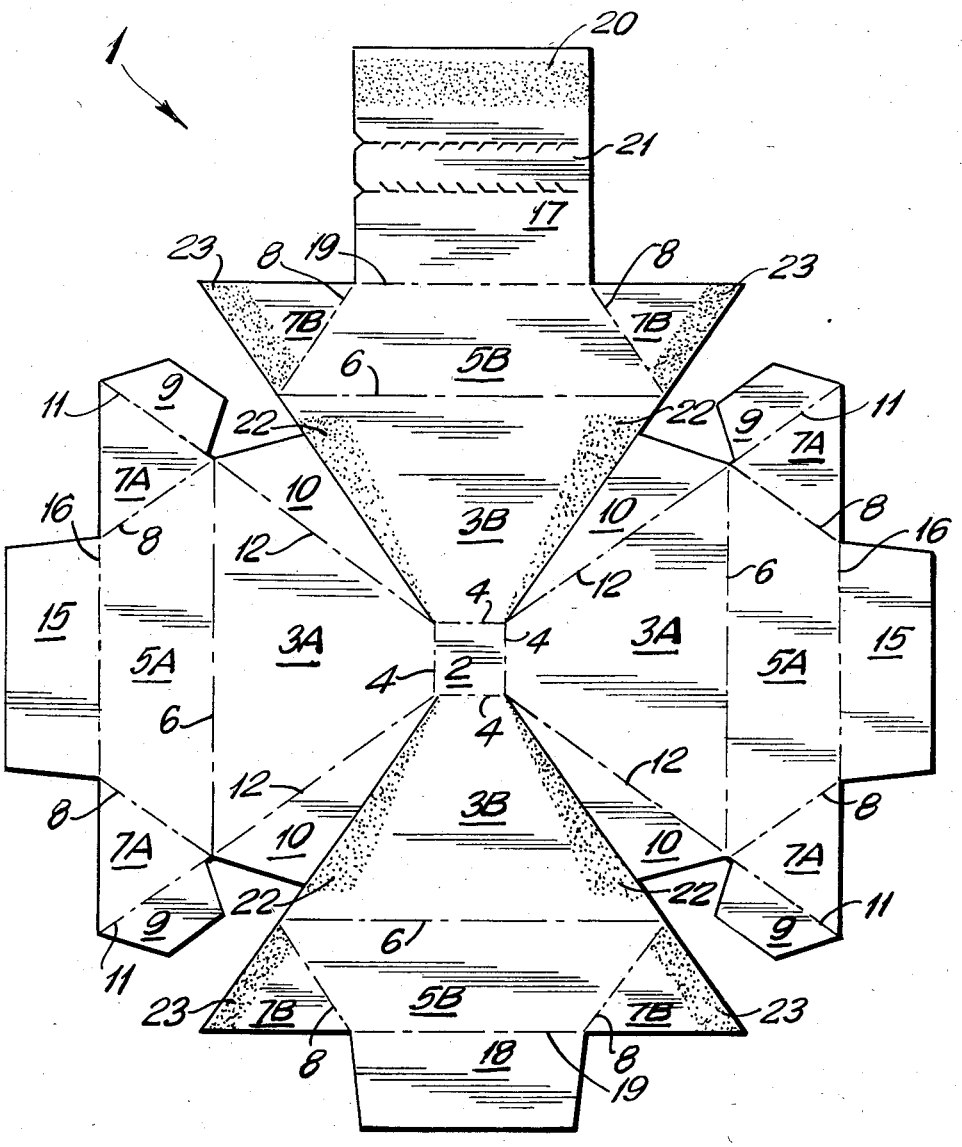
FIG. 1 is a plan view of a blank which may be used for making the outer carton of the present invention.

Referring more particularly to FIG. 1, the blank 1 for making the popcorn carton of the present invention comprises a small rectangular central panel 2 which in the preferred embodiment of the invention is shown as a square. From each side edge of the square panel 2, there extends a pair of opposed similarly shaped side wall panels 3A and 3B, each of which is preferably shaped in the form of a trapezoid and which is foldable relative to the panel 2 along fold lines 4. Opposed pairs of side wall panels 3A and 3B are provided with further side wall panels 5A and 5B extending outwardly therefrom and foldable relative thereto along fold lines 6. Each side wall panel 5A and 5B is trapezoidal in shape and has triangular end flaps 7A and 7B, respectively, extending from each end edge thereof and foldable relative thereto along fold lines 8.

A glue flap 9 extends from the end edge of each end flap 7A and is foldable relative thereto along a fold line 11. A triangular glue flap 10 extends from each end edge of each opposed side wall panels 3A and is foldable relative thereto along a fold line 12. A tuck flap 15 extends from each side wall panel 5A and is foldable relative thereto along a fold line 16.

Opposed side wall panels 5B are provided with closure panels 17 and 18 which are foldable relative to side wall panels 5B along fold lines 19. The closure panel 17 is longer than the closure panel 18 and is provided adjacent its outer edge with a glue area 20 adapted to be adhered to the outer surface of the closure panel 18 when the carton is completely assembled. A tear strip 21 is provided in closure panel 17 substantially mid-way thereof to permit the carton to be opened, as will be explained in greater detail hereinafter.

Figure 2:
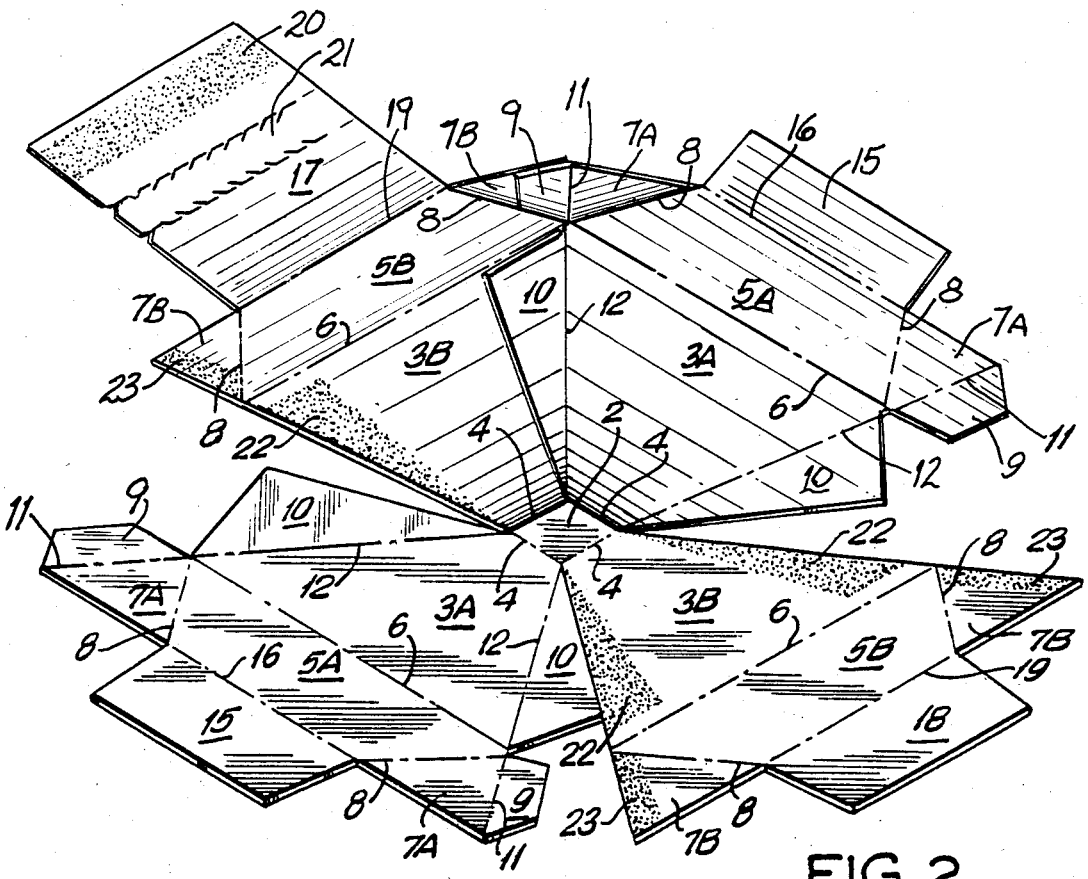
FIG. 2 is a perspective view showing one step in the folding of the blank to form the outer carton.
Figure 3:
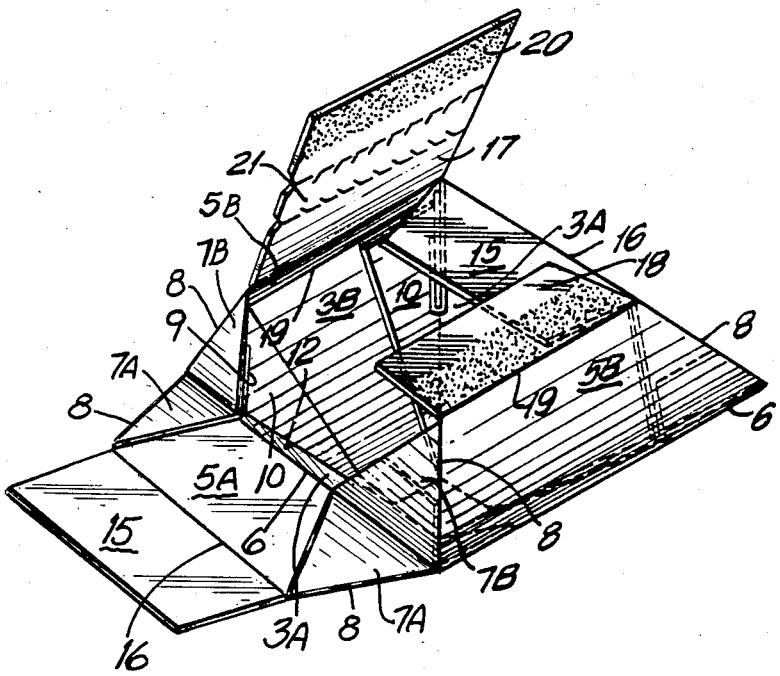
FIG. 3 is a perspective view showing the final step of folding the blank to form the outer carton.

To assemble the carton, the side wall panels 3A and 3B are pivoted inwardly about fold lines 4 as shown in FIG. 2 and the glue panels 10 are folded about fold lines 12 and adhered to the side walls 3B at the glue areas 22. The glue flaps 9 are folded about fold lines 11 and are adhered to the end flaps 7B at glue areas 23. In FIG. 3, the interconnected end flaps 7A and 7B are folded inwardly along fold lines 11 so that they project into the carton at the corners thereof. In performing these steps, the side wall panels 5A and 5B are folded inwardly toward the center of the carton to cause the carton to assume its erected form. The closure panels 17 and 18 are folded inwardly with the glue area 20 overlying and adhered to the outer surface of the opposed closure panel 18. The tuck flaps 15 are first folded inwardly to a position beneath the adhered closure panels 17 and 18.

Figure 5:
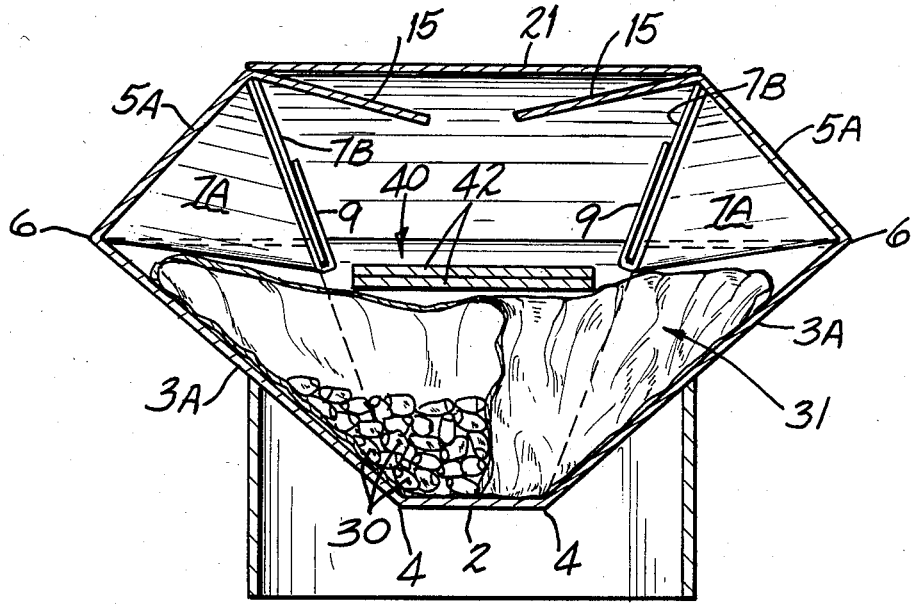
FIG. 5 is a sectional view taken along line 5—5 of FIG. 4.

The popcorn kernels 30 are packaged within a sealed expandable bag or pouch 31 (FIG. 5) which is positioned in the outer carton before the latter is closed and which is adhesively secured to the carton panel 2. It will be noted that the end flaps 7A and 7B project into the interior of the carton to hold the pouch 31 against the central panel 2 and adjacent portions of the wall panels 3A and 3B.

Figure 6:
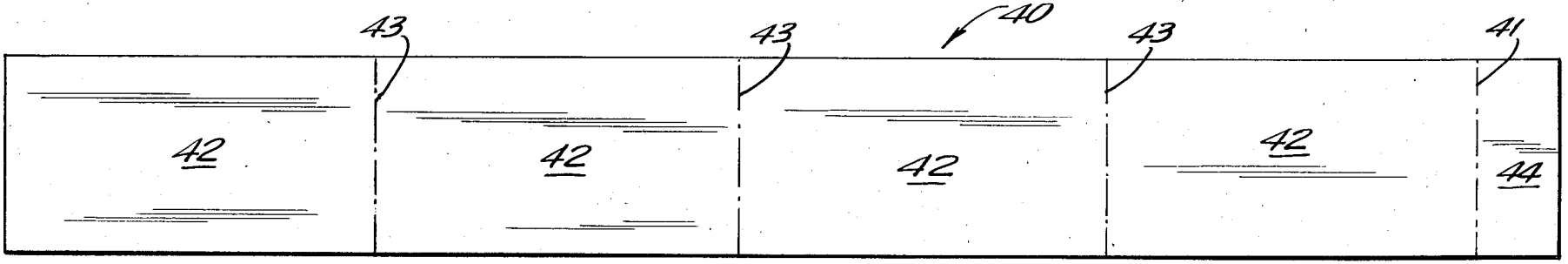
FIG. 6 is a plan view of a blank for forming the stand of the present invention.
Figure 8:
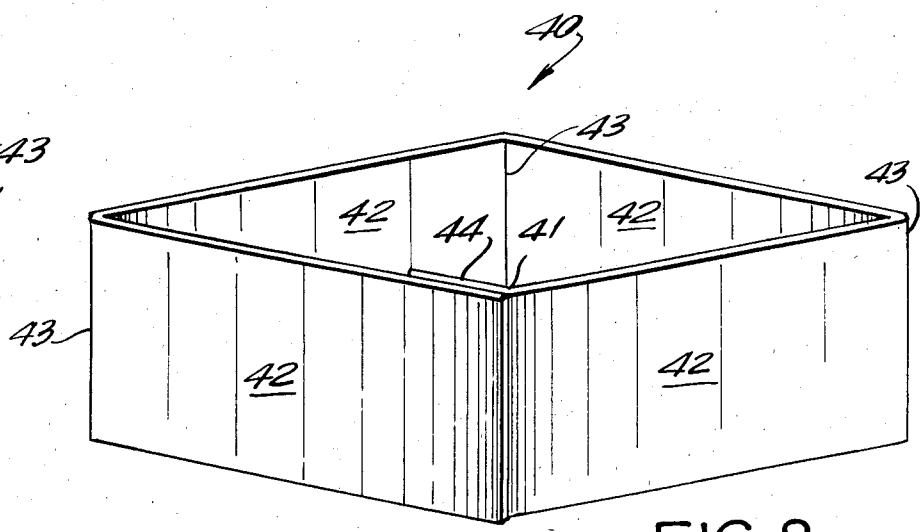
FIG. 8 is a perspective view showing the stand being flattened to permit it to be packaged within the outer carton.
Figure 7:
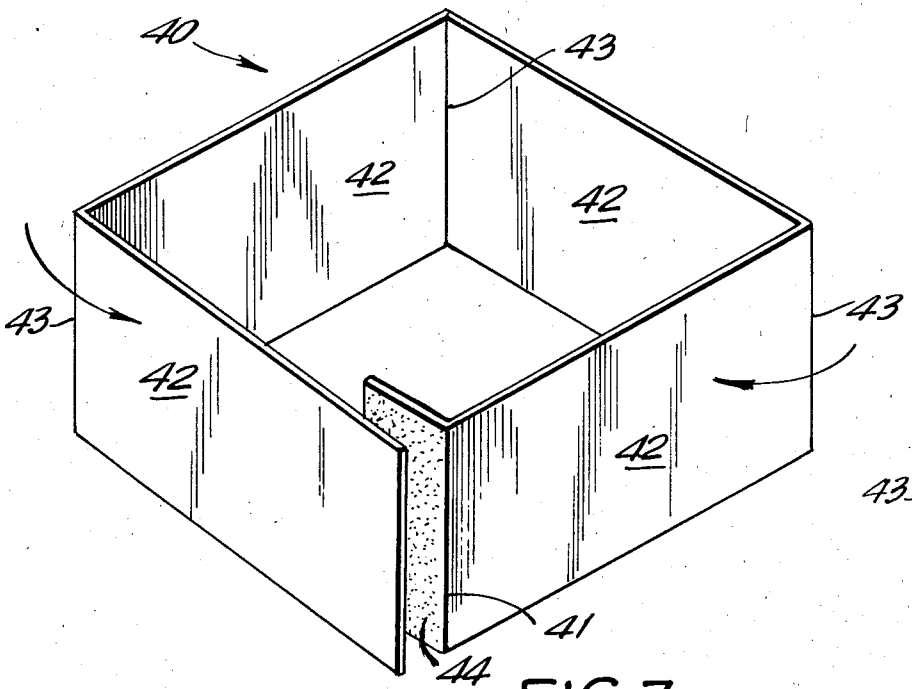
FIG. 7 is a perspective view showing the stand being erected.

The stand 40 of the present invention is made from a rectangular blank (FIG. 6) which has a plurality of side wall panels 42 foldable relative to each other along fold lines 43. The blank 40 is provided with a glue flap 44 which is foldable relative to an outer side wall panel 42 along fold line 41 and which is adhered to the other outer panel 42 of the blank. The panels 42 are preferably rectangular so that when the blank is folded, the resulting stand will be rectangular-shaped. The stand blank 40 is erected as shown in FIG. 7 and then folded into a flattened configuration as shown in FIG. 8 whereupon the flattened stand is placed within the outer carton (FIG. 5) before the outer carton is closed and sealed, as described above. Preferably, the stand has the same number of side walls as the number of side walls on the outer carton, i.e., four, for a purpose which will be more clearly explained hereinbelow.

Figure 4:
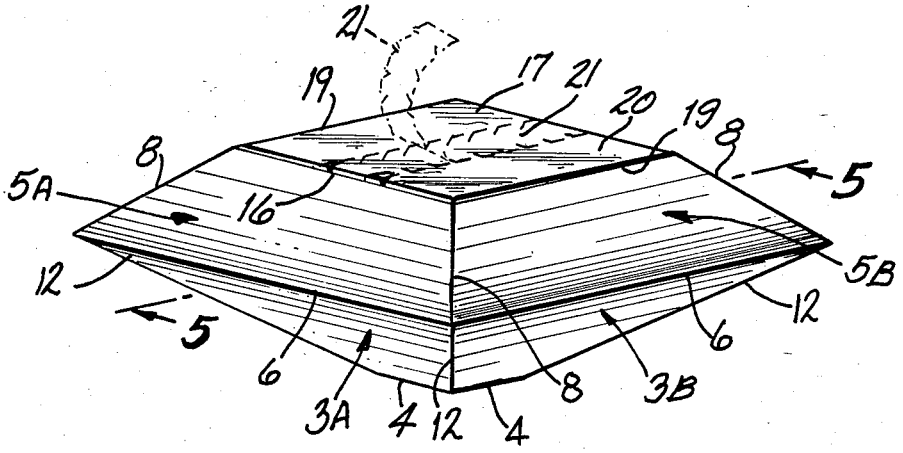
FIG. 4 is a perspective view showing the finished outer carton.

Referring to FIG. 4, it will be noted that the erected carton has the configuration of two base-to-base truncated pyramids wherein the common bases would lie in the plane of the fold lines 6. It will be noted that the truncated surface formed by the panel 17 is much larger than the truncated surface formed by the panel 2. When the carton is displayed on store shelves or is otherwise in storage, the panel 17 acts as a support base or bottom on which the carton rests. The panel 17 is made large enough to stably support the carton and graphics will be appropriately oriented. Thus, in storage, the carton will be inverted from the position in FIG. 4.

Figure 9:
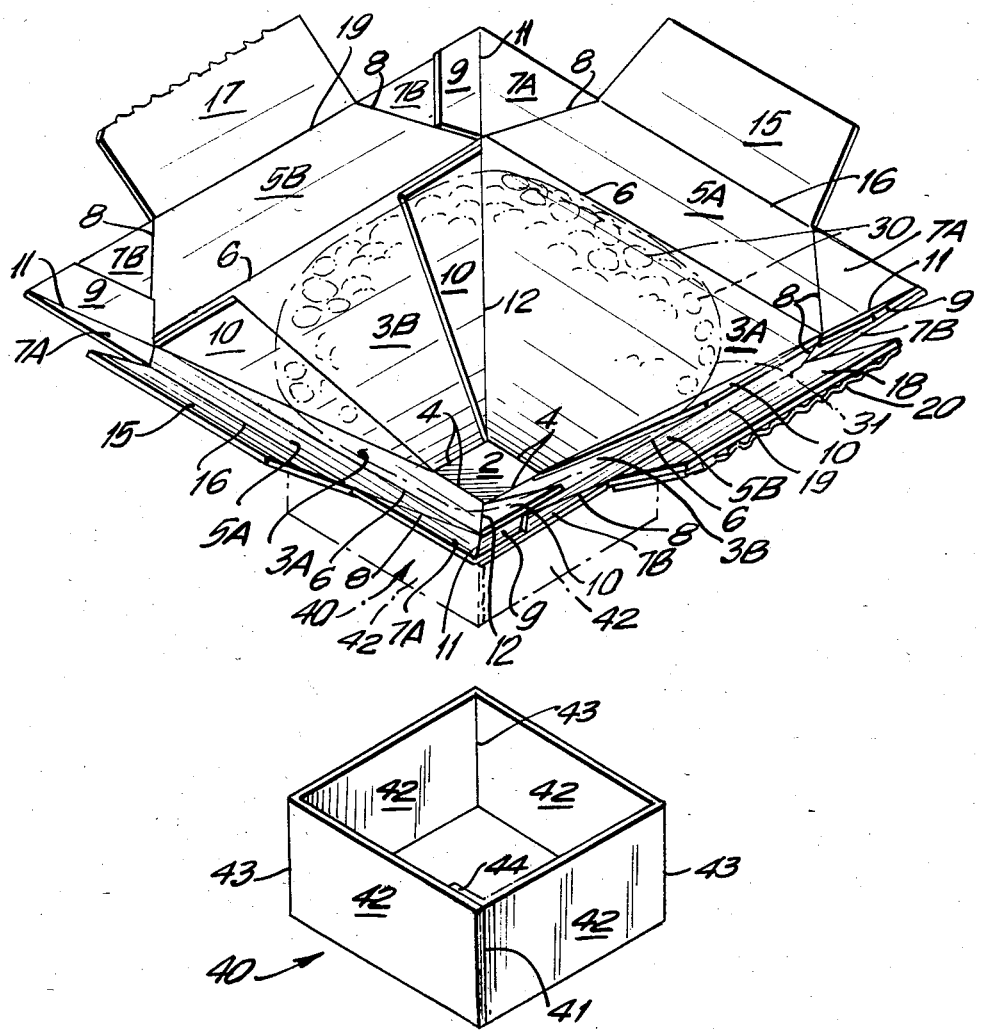
FIG. 9 is an exploded perspective view showing the outer carton resting on the stand when it is to be cooked in a microwave oven.

When the package is to be used, the carton will be oriented as shown in FIG. 4 and the tear strip 21 is removed so that glue area 20 remains adhered to closure panel 18 but is separated from the closure panel 17. The closure panels 17, 18 (with glue panel 20 still adhered thereto) and 15 are moved outwardly and the folded end flaps 7A and 7B are spread apart to open the carton, as shown in FIG. 9. It will be noted that the carton, when opened, has the configuration of an inverted truncated four-sided pyramid. The stand 40 is removed from within the carton and expanded into a square configuration and placed in a microwave oven. The opened carton is then placed on the stand 40. As the corn kernels 30 pop and expand, the inner pouch 31 will be free to expand to accommodate the volume of popped corn kernels.

The outer carton is placed on the stand 40 so that its bottom wall 2 is suspended above the floor of the oven for maximum energy efficiency. Since the stand 40 has the same number of side walls 42 as there are side walls 3A and 3B in the carton, the side walls 3A and 3B fit snugly with the upper edges of the side walls 42 of the stand 40 to insulate the popping portion of carton and minimize heat loss.

It will be noted from FIG. 9 that the small size of the central panel 2 allows the area of the carton thereabout to project relatively deeply into the stand. The portion of the carton interior defined by the central panel 2 and the parts of the wall panels 3A and 3B which lie below the upper edges of the stand 40 is insulated against heat loss by the stand and forms the popping area of the carton. The carton shape ensures that the popped corn kernels will continuously migrate downwardly to the area of greatest heat efficiency as popping progresses. When popping of the kernels ceases, the spread-open panels 15, 17 and 18 may be used to grasp the carton and remove it from the oven.

It will thus be seen that the present invention provides an improved popcorn package for use in microwave ovens which has greater heat efficiency and which is easy to manufacture and assemble with automatic machinery. The provision of two parallel panels at truncated areas of the carton provides dual advantages. One of the truncated panels will be relatively large so as to serve as a support base for the carton when the latter is stored. That same panel will provide means whereby the carton can be opened for use. The other of the truncated panels, by being made relatively small, ensures that a large area of the carton will be heat insulated when the carton is placed on the stand and also ensures that unpopped kernels will migrate continuously down into the insulated hot popping area as the corn is being popped in the carton.

As many and varied modifications of the subject matter of this invention will become apparent to those skilled in the art from the detailed description given hereinabove, it will be understood that the present invention is limited only as provided in the claims appended hereto.

What is claimed is:

1. A carton for microwave cooking of food, said carton being formed from a one-piece paperboard blank, and said carton comprising:

(a) a central rectangular panel;

(b) first trapezoidal side wall panels foldably connected to edges of said central rectangular panel with ends of said first trapezoidal side wall panels being foldably connected together, said first trapezoidal side wall panels combining with said central rectangular panel to form a first truncated pyramidal portion of said carton;

(c) a plurality of overlapping closure panels adhesively secured together to form a generally planar rectangular closure for said carton which rectangular closure is parallel to said central rectangular panel;

(d) second trapezoidal side wall panels foldably connected to edges of said rectangular closure with ends of said second trapezoidal side wall panels being foldably connected together, said second trapezoidal side wall panels combining with said rectangular closure to form a second truncated pyramidal portion of said carton;

(e) said first and second truncated pyramidal portions of said carton being foldably joined together along fold lines interconnecting the longer of the parallel edges of each pair of adjacent first and second trapezoidal side wall panels with said fold lines lying in an imaginary plane defining a common base for each of said first and second truncated pyramidal portions of said carton with said imaginary plane being interposed between said central rectangular panel and said planar rectangular closure; and (f) said rectangular closure being substantially larger in area than said central rectangular panel to form a stable base for supporting said carton in storage or on display.

2. The carton of claim 1 further comprising pairs of end wall panels forming the foldable connection between the ends of said second trapezoidal side wall panels, each end wall panel in each pair thereof being foldably connected to end edges of adjacent ones of said second trapezoidal side wall panels and foldably connected to each other, with each pair of said end wall panels projecting into the interior of said carton to retain a portion of the contents thereof in position within the confines of said first truncated pyramidal portion of said carton.

3. In combination with the carton of claim 1, a rectangular stand folded into a flat configuration and disposed within the confines of said carton adjacent said rectangular closure, said stand when expanded having four upstanding sides providing a supporting surface on said stand for engaging throughout the entire extent of said supporting surface each of said first trapezoidal side wall panels.

* * * * *